US006480158B2

(12) United States Patent
Apostolos

(10) Patent No.: US 6,480,158 B2
(45) Date of Patent: Nov. 12, 2002

(54) NARROW-BAND, CROSSED-ELEMENT, OFFSET-TUNED DUAL BAND, DUAL MODE MEANDER LINE LOADED ANTENNA

(75) Inventor: John T. Apostolos, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 09/871,038

(22) Filed: May 31, 2001

(65) Prior Publication Data

US 2001/0050640 A1 Dec. 13, 2001

Related U.S. Application Data

(60) Provisional application No. 60/208,194, filed on May 31, 2000.

(51) Int. Cl.[7] ..... H01Q 1/36

(52) U.S. Cl. ..... 343/700 MS; 343/744; 343/742; 343/867

(58) Field of Search ..... 343/700 MS, 741, 343/742, 744, 745, 749, 846, 866, 867, 797

(56) References Cited

U.S. PATENT DOCUMENTS

| | | | | |
|---|---|---|---|---|
| 3,633,207 A | | 1/1972 | Ingerson et al. | |
| 3,754,271 A | | 8/1973 | Epis | |
| 3,849,745 A | | 11/1974 | Schellenberg et al. | |
| 4,293,858 A | | 10/1981 | Hockham | |
| 4,804,965 A | | 2/1989 | Roederer | |
| 4,809,009 A | | 2/1989 | Grimes et al. | |
| 5,406,292 A | | 4/1995 | Schnetzer et al. | |
| 5,422,650 A | * | 6/1995 | Hill | 343/713 |
| 5,481,272 A | | 1/1996 | Yarsunas | |
| 5,521,610 A | | 5/1996 | Rodal | |
| 5,592,182 A | | 1/1997 | Yao et al. | |
| 5,719,586 A | | 2/1998 | Tuttle | |
| 5,751,252 A | | 5/1998 | Phillips | |
| 5,754,143 A | | 5/1998 | Warnagiris et al. | |
| 5,767,810 A | | 6/1998 | Hagiwara et al. | |
| 5,784,032 A | | 7/1998 | Johnston et al. | |
| 5,790,080 A | | 8/1998 | Apostolos | |
| 5,917,450 A | | 6/1999 | Tsunekawa et al. | |
| 5,936,587 A | | 8/1999 | Gudilev et al. | |
| 5,973,650 A | * | 10/1999 | Nakanishi | 343/742 |
| 6,008,762 A | | 12/1999 | Nghiem | |
| 6,034,637 A | | 3/2000 | McCoy et al. | |
| 6,100,694 A | | 8/2000 | Wong | |
| 6,104,348 A | | 8/2000 | Karlsson | |
| 6,147,647 A | | 11/2000 | Tassoudji | |
| 6,304,230 B1 | * | 10/2001 | Panther et al. | 343/867 |

FOREIGN PATENT DOCUMENTS

| | | |
|---|---|---|
| WO | WO 00/52784 | 9/2000 |
| WO | WO 01/13464 A1 | 2/2001 |

OTHER PUBLICATIONS

PCT International Search Report dated Sep. 13, 2001 of International Application No. PCT/US01/17560 filed May 31, 2001.

* cited by examiner

*Primary Examiner*—Tan Ho
(74) *Attorney, Agent, or Firm*—Scott J. Asmus; Maine & Asmus

(57) ABSTRACT

The present invention features a dual-band meander line loaded antenna (MLA) that operates in a loop mode for a first frequency band and utilizes capacitive tuning to adjust the monopole resonant frequency for a second frequency band. In one embodiment orthogonal MLA elements are equipped with one or more capacitive flaps to lower the monopole resonant frequency of the structure. By offset-tuning the MLA elements and properly feeding RF signals, the inventive antenna exhibits vertically polarized operation at a first operating frequency and circular polarization at a second operating frequency. A typical use for the inventive antenna is for a dual-purpose cellular phone and GPS antenna. In cellular phone mode, the antenna operates at approximately 845 MHz with vertical polarization while simultaneously operating with circular polarization as at 1.5 GHz for GPS services.

17 Claims, 7 Drawing Sheets

NARROW-BAND, CROSSED-ELEMENT, OFFSET-TUNED DUAL BAND, DUAL MODE MEANDER LINE LOADED ANTENNA

CROSS-REFERENCE TO RELATED APPLICATION

This application claims priority to U.S. Provisional Patent Application Ser. No. 60/208194 filed May 31, 2000.

FIELD OF THE INVENTION

The invention pertains to meander line loaded antennas and more particularly to such an antenna that operates simultaneously in two different modes and two different frequency bands.

BACKGROUND OF THE INVENTION

In the past efficient antennas have typically required structures with minimum dimensions on the order of a quarter wavelength of the radiating frequency. These dimensions allowed the antenna to be excited easily and to be operated at or near a resonance, limiting the energy dissipated in resistive losses and maximizing the transmitted energy. However, these antennas tended to be large in size at the resonant wavelength. Further, as frequency decreased, the antenna dimensions increased in proportion.

As the demand for smaller communication devices has surged, there is a growing need for compact antenna designs. Furthermore, there is a strong interest in antennas that operate in multiple frequency bands.

In order to address some of the shortcomings of traditional antenna design and functionality, the meander line loaded antenna (MLA) was developed. One MLA is disclosed in U.S. Pat. No. 5,790,080, for MEANDER LINE LOADED ANTENNA that is hereby incorporated by reference. An example of a MLA, sometimes labeled as a varied impedance transmission line antenna, is shown therein. The antenna consists of two vertical conductors and a horizontal conductor. The vertical and horizontal conductors are separated by gaps that use meander lines, which are connected between the vertical and horizontal conductors at the gaps.

The meander line is designed to adjust the electrical length of the antenna. In addition, the design of the meander slow wave structure permits lengths of the meander line to be switched in or out of the circuit quickly and with negligible loss, in order to change the effective electrical length of the antenna. This switching is possible because the active switching devices are always located in the high impedance sections of the meander line. This keeps the current through the switching devices low and results in very low dissipation losses in the switch, thereby maintaining high antenna efficiency.

The basic antenna of the aforesaid patent can be operated in a loop mode that provides a "figure eight" coverage pattern. Horizontal polarization, loop mode, is obtained when the antenna is operated at a frequency such that the electrical length of the entire line, including the meander lines, is a multiple of full wavelength. The antenna can also be operated in a vertically polarized, monopole mode, by adjusting the electrical length to an odd multiple of a half wavelength at the operating frequency. The meander lines can be tuned using electrical or mechanical switches to change the mode of operation at a given frequency, or to switch frequency using a given mode.

The invention of the meander line loaded antenna significantly reduces the dimensions of the unit, while maintaining an electrical length that is still a multiple of a quarter wavelength of the operating frequency. Antennas and radiating structures of this type operate in the region where the limitations on their fundamental performance is governed by the Chu-Harrington relation:

$$\text{Efficiency}=FV_2Q$$

where:

Q=Quality Factor $V_2$=Volume of the structure in cubic wavelengths

F=Geometric Form Factor (F=64 for a cube or a sphere)

Meander line loaded antennas achieve the efficiency limit of the Chu-Harrington relation while allowing the antenna size to be much less than a wavelength at the frequency of operation. Height reductions of 10 to 1 can be achieved over quarter wave monopole antennas while achieving comparable gain.

Existing MLAs are narrow band antennas, with the switchable meander line allowing the antennas to cover wide frequency bands. However, the instantaneous bandwidth is always narrow. For many military applications and for commercial applications where signals can appear unexpectedly over a wide frequency range, the existing MLA antenna would not be satisfactory.

Discussion of the Related Art

The aforementioned U.S. Pat. No. 5,790,080 describes an antenna that includes one or more conductive elements for acting as radiating antenna elements, and a slow wave meander line adapted to couple electrical signals between the conductive elements. The slow wave meander line has an effective electrical length that affects the electrical length and operating characteristics of the antenna. The electrical length and operating mode of the antenna may be readily controlled and manipulated via switching.

U.S. Pat. No. 6,034,637 for DOUBLE RESONANT WIDEBAND PATCH ANTENNA AND METHOD OF FORMING SAME, describes a double resonant wideband patch antenna that includes a planar resonator forming a substantially trapezoidal shape having a non-parallel edge for providing a wide bandwidth. A feed line extends parallel to the non-parallel edge for coupling while a ground plane extends beneath the planar resonator for increasing radiation efficiency.

U.S. Pat. No. 6,008,762 for FOLDED QUARTER WAVE PATCH ANTENNA, describes a folded quarter-wave patch antenna which includes a conductor plate having first and second spaced apart arms. A ground plane is separated from the conductor plate by a dielectric substrate and is approximately parallel to the conductor plate. The ground plane is electrically connected to the first arm at one end and a signal unit is electrically coupled to the first arm. The signal unit transmits and/or receives signals having a selected frequency band. The folded quarter-wave patch antenna can also act as a dual frequency band antenna. In dual frequency band operation, the signal unit provides the antenna with a first signal of a first frequency band and a second signal of a second frequency band.

A DUAL BAND BOWTIE/MEANDER ANTENNA is described in PCT Patent International Application number WO 01/3464. This invention discloses dipole radiating elements and a ground plane on opposing sides of a dielectric material.

Despite the advances of the prior art designs, there continues to be a need to an efficient dual band antenna to address the problems addressed herein. There is a need for an antenna structure suitable for use in dual bands, such as a cellular phone and as a global positioning system (GPS) antenna. In this particular application, however, the cellular phone antenna must provide vertical polarization while the GPS antenna must have circular polarization.

SUMMARY OF THE INVENTION

In accordance with the present invention there is provided a dual-band, meander line loaded antenna (MLA) which utilizes a crossed pair of MLA elements to provide an antenna operable in two discrete frequency bands and having either vertical or circular polarization.

It is, therefore, an object of the invention to provide a dual-band, offset-tuned, meander line loaded antenna (MLA) constructed as a crossed pair of MLA elements.

It is another object of the invention to provide a dual band MLA wherein at least one of the MLA elements is equipped with a capacitive flap to reduce its resonant frequency.

It is a further object of the invention to provide a dual-band MLA selectively operable with either vertical or circular polarization.

One object of the invention that is distinguishable from the prior art, is the use of capacitive flaps for changing the resonant frequency and to stagger or offset tune the phase of the monopole mode. The capacitive flaps are added to the basic MLA loop design so as to lower the monopole resonant frequency of the structure. By using a crossed pair of offset-tuned MLA elements, a dual frequency antenna may be constructed. In addition, the crossed arrangement allows for operation as either a vertically or a circularly polarized antenna.

It is an additional object of the invention to provide a dual-band MLA adapted for combined cellular phone and GPS service.

On object of the invention is a dual-band antenna for simultaneous operation in two frequency bands, comprising a ground plane, a first meander line loaded antenna element tuned to a first loop mode frequency and having a first monopole resonant frequency. The first antenna element is disposed upon the ground plane. There is a second meander line loaded antenna element tuned to a second loop mode frequency, the second antenna element having a second monopole resonant frequency, wherein the second antenna element is also disposed upon the ground plane. There is a means for capacitive tuning the first monopole resonant frequency of the first antenna element to a first monopole frequency and a means for capacitive tuning the second monopole resonant frequency of said second meander line loaded antenna element to a second monopole frequency.

Another object is a dual-band antenna, wherein the first and the second monopole frequency are tuned such that a center frequency is approximately 3 dB in the frequency domain.

Yet a further object is a dual-band antenna wherein the means for capacitive tuning comprises flaps affixed to the first and second antenna elements. In one embodiment a first frequency band is centered at approximately 850 MHz and a second frequency band is centered at approximately 1.5 GHz. And, the dual-band antenna exhibits vertical polarization in the first frequency band and circular polarization in the second frequency band.

An object of the invention is a dual-band antenna comprising a ground plane, a first meander line loaded antenna element tuned to a first loop mode frequency and having a first monopole resonant frequency, wherein the first antenna element is disposed upon the ground plane. A second meander line loaded antenna element tuned to a second loop mode frequency and disposed substantially orthogonal to said first antenna element and upon the ground plane, with the second antenna element having a second monopole resonant frequency. One or more capacitive flaps are mounted to the first antenna element for tuning the first monopole resonant frequency, and one or more capacitive flaps are mounted to the second antenna element for tuning the second monopole resonant frequency.

An additional object is the dual-band antenna, wherein the flaps are metal with a dielectric material surrounding the metal. The first and second meander line loaded element each comprise a pair of vertical sides extending from the ground plane and a top cover between the vertical sides, wherein there is a gap between the top cover and the vertical sides with the capacitive flaps mounted to each top cover at the gaps. Furthermore, wherein the tuning is performed by adjusting a spacing between the vertical sides and the flaps.

Another object is the dual-band antenna produced by the process of tuning the first monopole resonant frequency to a desired monopole frequency band and tuning the second monopole resonant frequency to the desired monopole frequency band. And, offset tuning either the first or second antenna element to produce a zero degree monopole phase difference between the first and second antenna element.

And yet a further object is a dual-band antenna comprising a ground plane, a first bow-tie meander line loaded antenna element tuned to a first loop mode frequency and having a first monopole resonant frequency, the first antenna element being disposed upon the ground plane. There is a second bow-tie meander line loaded antenna element tuned to a second loop mode frequency and disposed substantially orthogonal to the first antenna element and upon the ground plane, the second antenna element having a second monopole resonant frequency. One or more capacitive flaps are mounted to the first antenna element for tuning the first monopole resonant frequency and one or more capacitive flaps are mounted to the second antenna element for tuning the second monopole resonant frequency. The first and second bow-tie meander line loaded elements each comprise a vertical side extending perpendicularly from the ground plane and a triangle-shaped horizontal section extending from the vertical side, wherein there are side gaps between the horizontal section and the vertical sides with the capacitive flaps mounted at the side gaps.

And yet an additional object is the dual-band antenna wherein the capacitive flaps are exteriorly or interiorly disposed upon the antenna elements. Also, wherein the capacitive flaps are electrically connected to the horizontal section and isolated from the vertical sides. Alternatively, wherein the capacitive flaps are electrically connected to the vertical sides and isolated from the horizontal section. Finally, wherein the one or more capacitive flaps are electrically isolated from the vertical sides and the horizontal section.

Still other objects and advantages of the present invention will become readily apparent to those skilled in this art from the following detailed description, wherein I have shown and described only a preferred embodiment of the invention, simply by way of illustration of the best mode contemplated by me on carrying out my invention. As will be realized, the invention is capable of other and different embodiments, and its several details are capable of modifications in various obvious respects, all without departing from the invention.

BRIEF DESCRIPTION OF THE DRAWINGS

A complete understanding of the present invention may be obtained by reference to the accompanying drawings, when considered in conjunction with the subsequent detailed description, in which.

DETAILED DESCRIPTION OF THE PREFERRED EMBODIMENT

This present invention provides a dual-band, crossed element MLA structure that provides for operation in two discrete frequency bands. In addition, both vertical and circular polarization may be obtained from the inventive antenna by modifying its signal feed arrangement.

Figure 1:
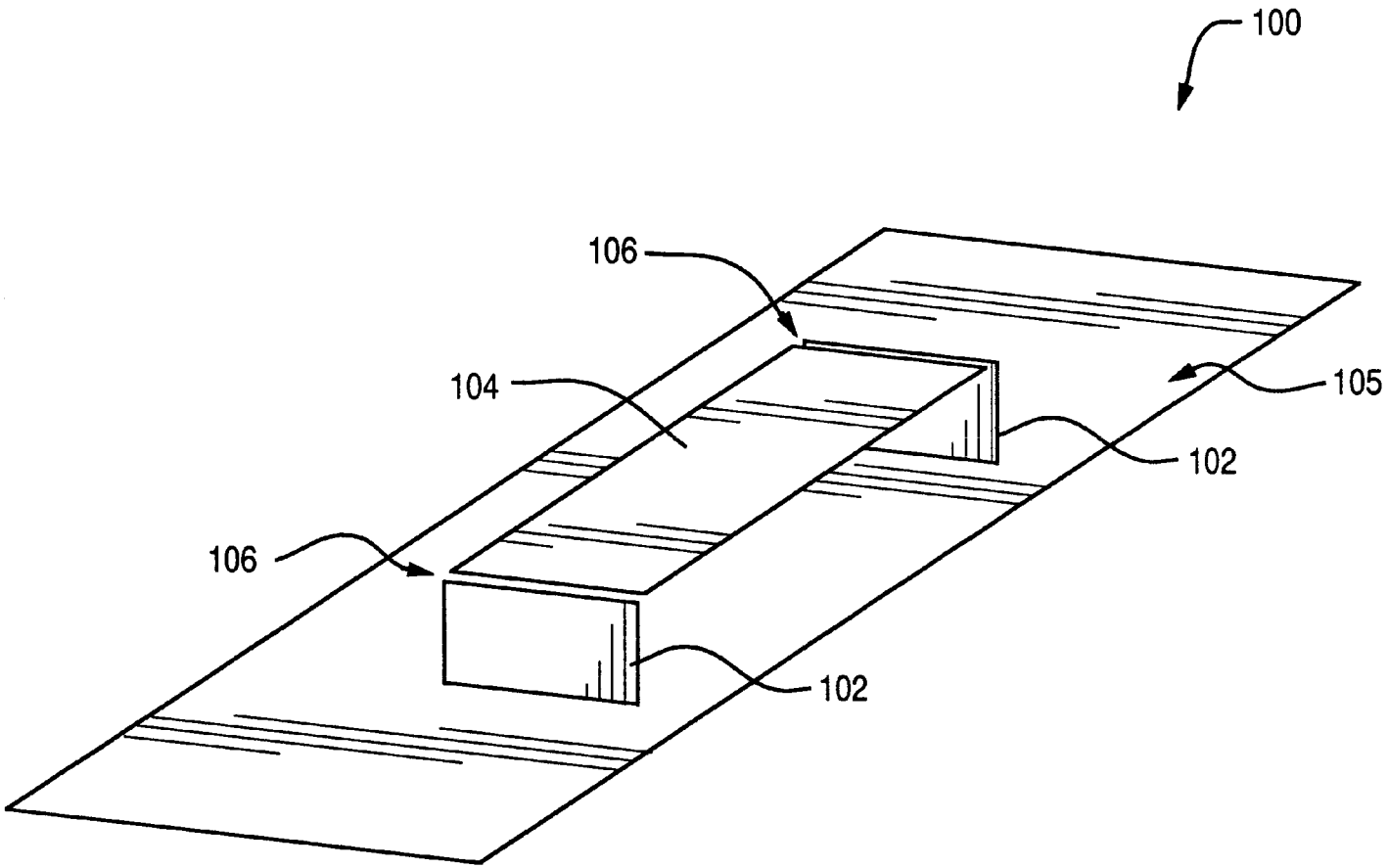
FIG. 1 (PRIOR ART)
FIG. 1 is a schematic, perspective view of a meander line loaded antenna of the prior art.
Figure 2:
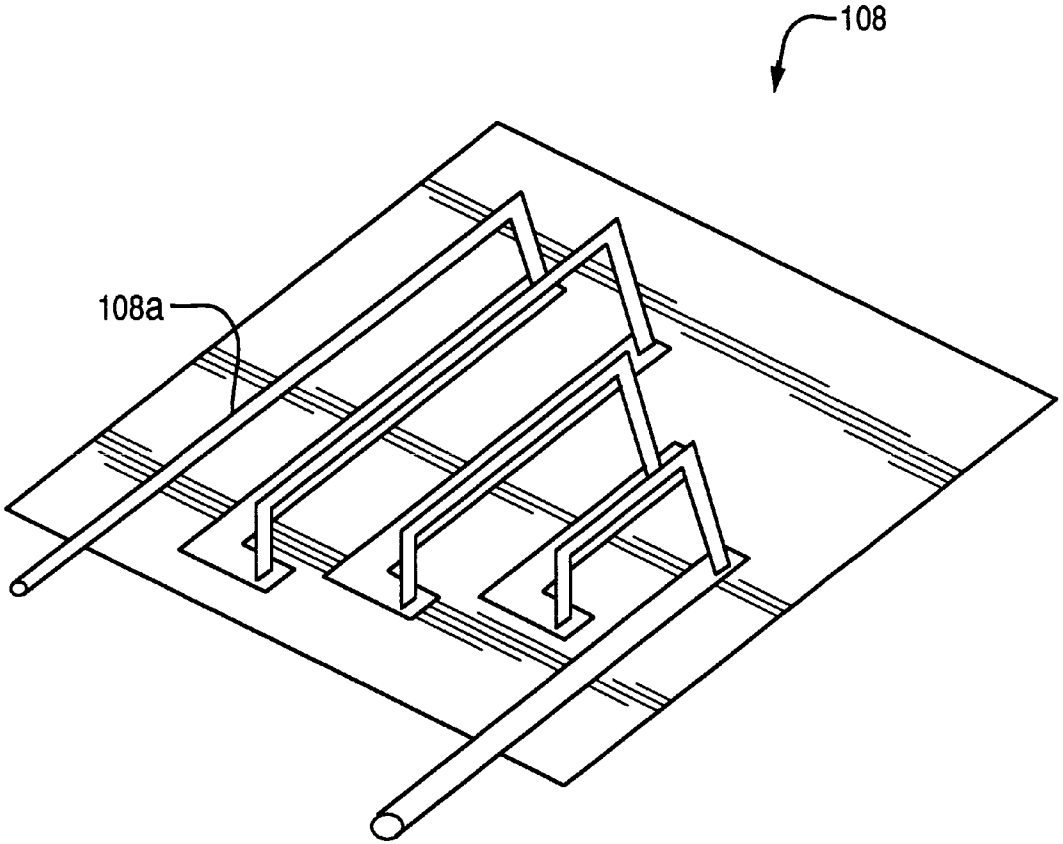
FIG. 2 (PRIOR ART)
FIG. 2 is a schematic perspective view of a meander line loaded used as an element coupler in the meander line loop antenna of FIG. 1.
Figure 3:
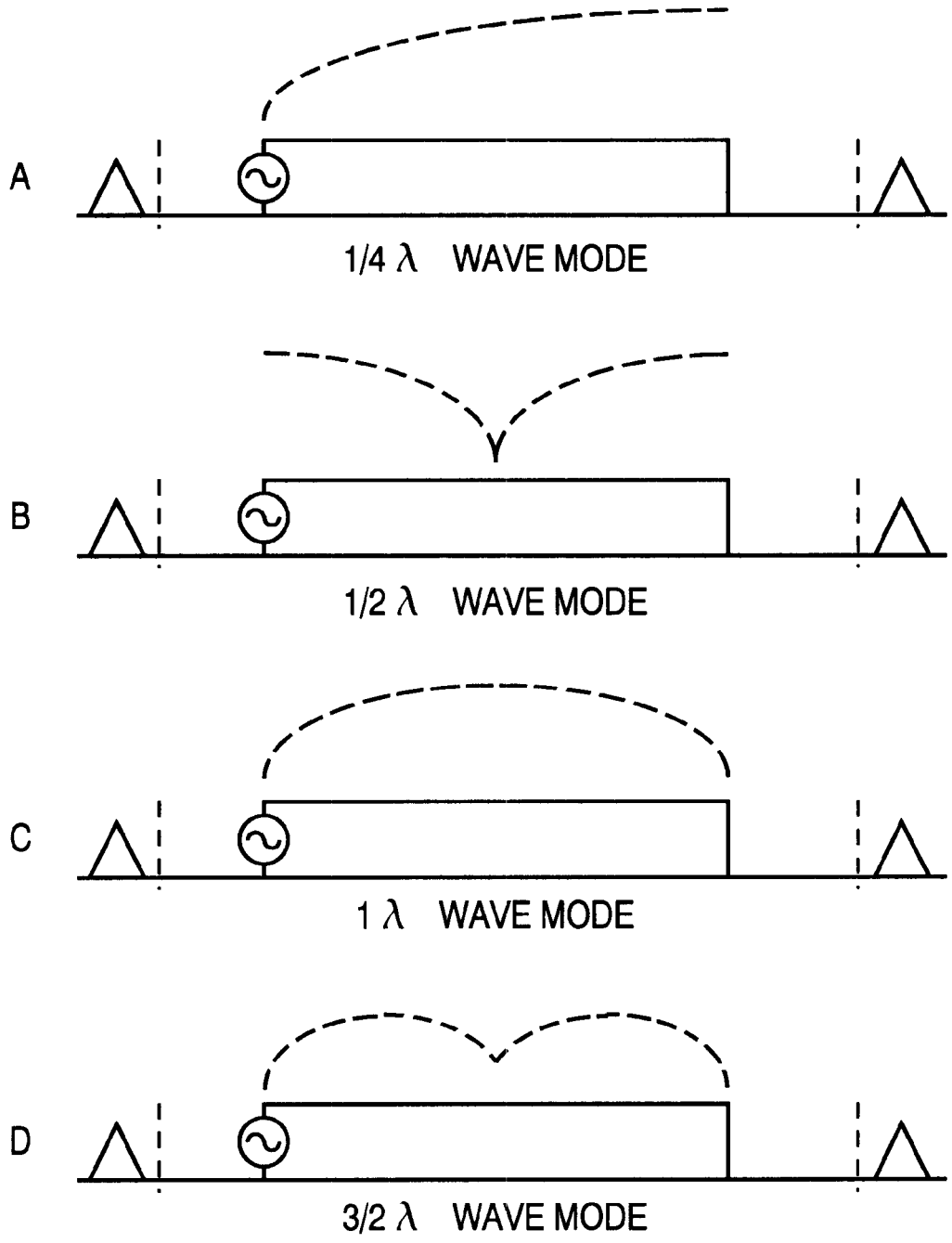
FIG. 3 (PRIOR ART)
FIG. 3, consisting of a series of diagrams 3A–3D, depicts four operating modes of the meander line loaded antenna.

FIG. 1 illustrates the prior art meander line loaded structure 100 described in more detail is U.S. Pat. No. 5,790,080. A pair of opposing side units 102 are connected to a ground plane 105 and extend substantially orthogonal from the ground plane 105. A horizontal top cover 104 extends between the side pieces 102, but does not come in direct contact with the side units 102. Instead, there are gaps 106 separating the side pieces 102 from the top cover 104. A meander line loaded element 108, such as the one depicted in FIG. 2 is placed on the inner corners of the structure 100 such that the meander line 108 resides near the gap on either the horizontal cover 104 or the side pieces 102.

The meander line loaded structure 108 provides a switching means to change the electrical length of the line and thereby affect the properties of the structure 100. As explained in more detail in the prior art, the switching enables the structure to operate in loop mode or monopole mode by altering the electrical length and hence the wavelengths as shown in FIGS. 3A–D.

Figure 4A:
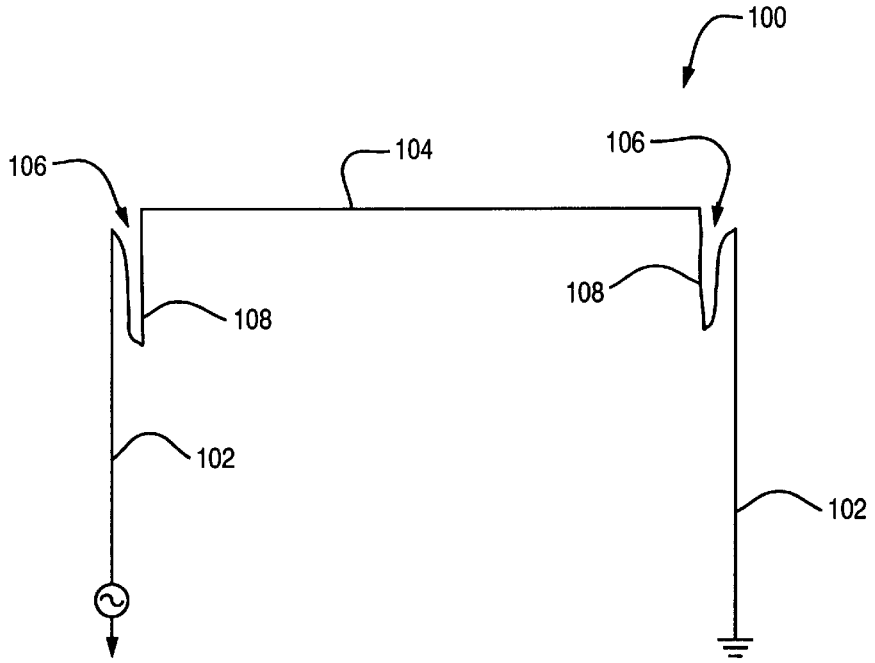
FIG. 4A (PRIOR ART)
FIG. 4*a* is a schematic, cross-sectional view of a traditional MLA loop element.

Referring first to FIG. 4*a,* there is shown a schematic, cross-sectional view of one conventional MLA element, at reference number 100. Two vertical radiating surfaces 102 are separated from a horizontal surface 104 by gaps 106. A pair of meander lines 108 is connected between vertical surfaces 102 and horizontal surface 104. Meander lines 108 may be mounted on either the vertical surface 102 or the horizontal surface 104 as described in the prior art. For the application selected for purposes of this disclosure, antenna 100 has a loop mode response modified to approximately 1.5 GHz (i.e., the GPS operating frequency). When so constructed, antenna 100 has a naturally occurring monopole resonant frequency of approximately 860 MHz.

Figure 4B:
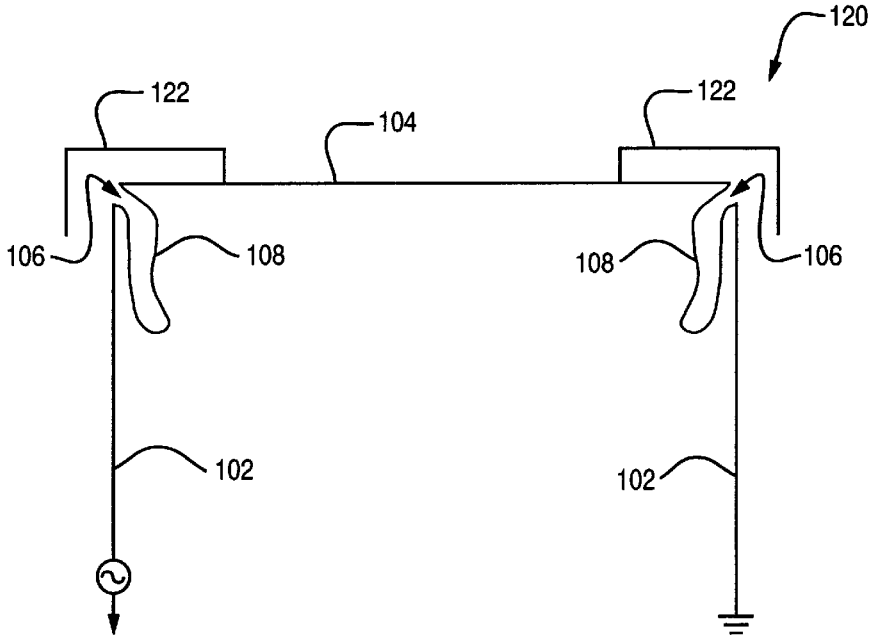
FIG. 4B (PRIOR ART)
FIG. 4*b* is a schematic, cross-sectional view of the MLA loop element of FIG. 4*a* with capacitive flaps added to lower its monopole resonant frequency.

Referring now also to FIG. 4*b,* there is shown one MLA element similar to that of FIG. 4*a,* generally at reference number 120. Two vertical radiating surfaces 102 are separated from a horizontal surface 104 by gaps 106. Meander lines 108 are shown as before, with capacitive flaps 122 added to horizontal surface 104.

Capacitive flaps 122 provide a shunt capacitance that effectively lowers the monopole resonant frequency and alters the monopole operation. In the example chosen for purposes of disclosure, the monopole resonant frequency is reduced from approximately 860 MHz to approximately 830 MHz, the latter frequency being chosen because it is a typical cellular phone operating frequency. The addition of shunt capacitance from capacitive flaps 122 does not affect the loop mode frequency response of MLA element 120, and its operation in the 1.5 GHz GPS frequency band is unaffected. As there are two separate antenna elements, it may be necessary to lower the resonant frequency of both antenna elements.

To achieve circular polarization, MLA elements 100, 120 are fed in quadrature (i.e., the voltage feeds are 90° out-of phase) as is well known to those skilled in the antenna design arts. Because the shunt capacitance added to MLA element 120 by capacitive flaps 122 does not affect the loop frequency response of element 120 at the 1.5 GHz frequency, the two elements 100, 120 are electrically identical and the capacitive flaps 122 do not interfere with the loop mode operation.

Figure 5:
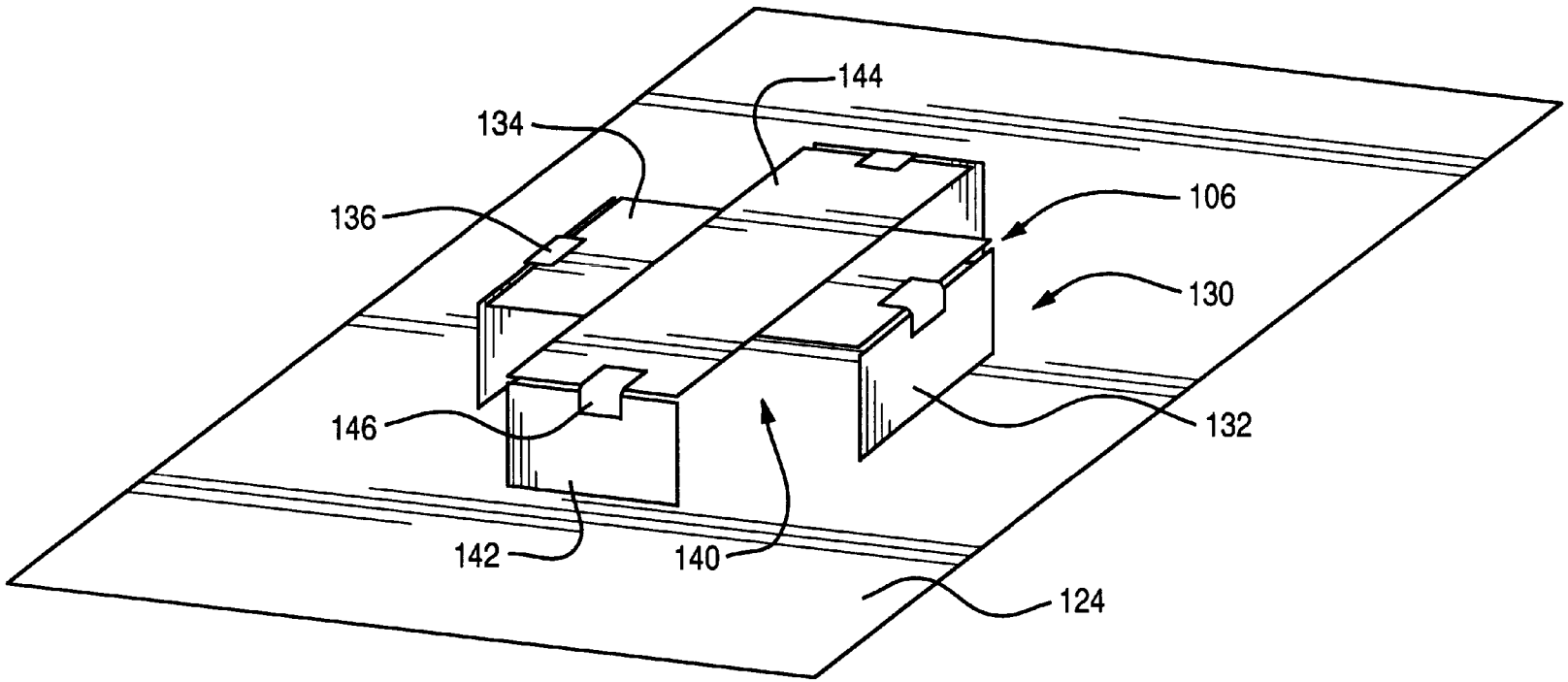
FIG. 5 is a schematic, perspective view of the dual band, crossed-element MLA antenna of the present invention.

Referring now to FIG. 5, there is shown a perspective view of one embodiment of the crossed-element, offset-tuned MLA antenna. A lower MLA element 130 is shown disposed above a common ground plane 124. The lower MLA element has an upper piece 134 and a pair of side pieces 132. There are a pair of capacitive flaps 136 disposed upon the upper piece 134 and capacitively coupled to side pieces 132. Likewise, an upper MLA element 140 is also disposed above common ground plane 124 and is orthogonal to the lower MLA element 130. The upper MLA element 140 has an upper piece 144 and a pair of side pieces 142. There are a pair of capacitive flaps 146 disposed upon the upper piece 144 and capacitively coupled to side pieces 146.

This embodiment requires that the two orthogonal monopole antennas 130 and 140 be each tuned in a first instance to obtain the proper frequency band, and then be tuned to obtain a zero degree phase difference for the monopole operation.

Figure 6:
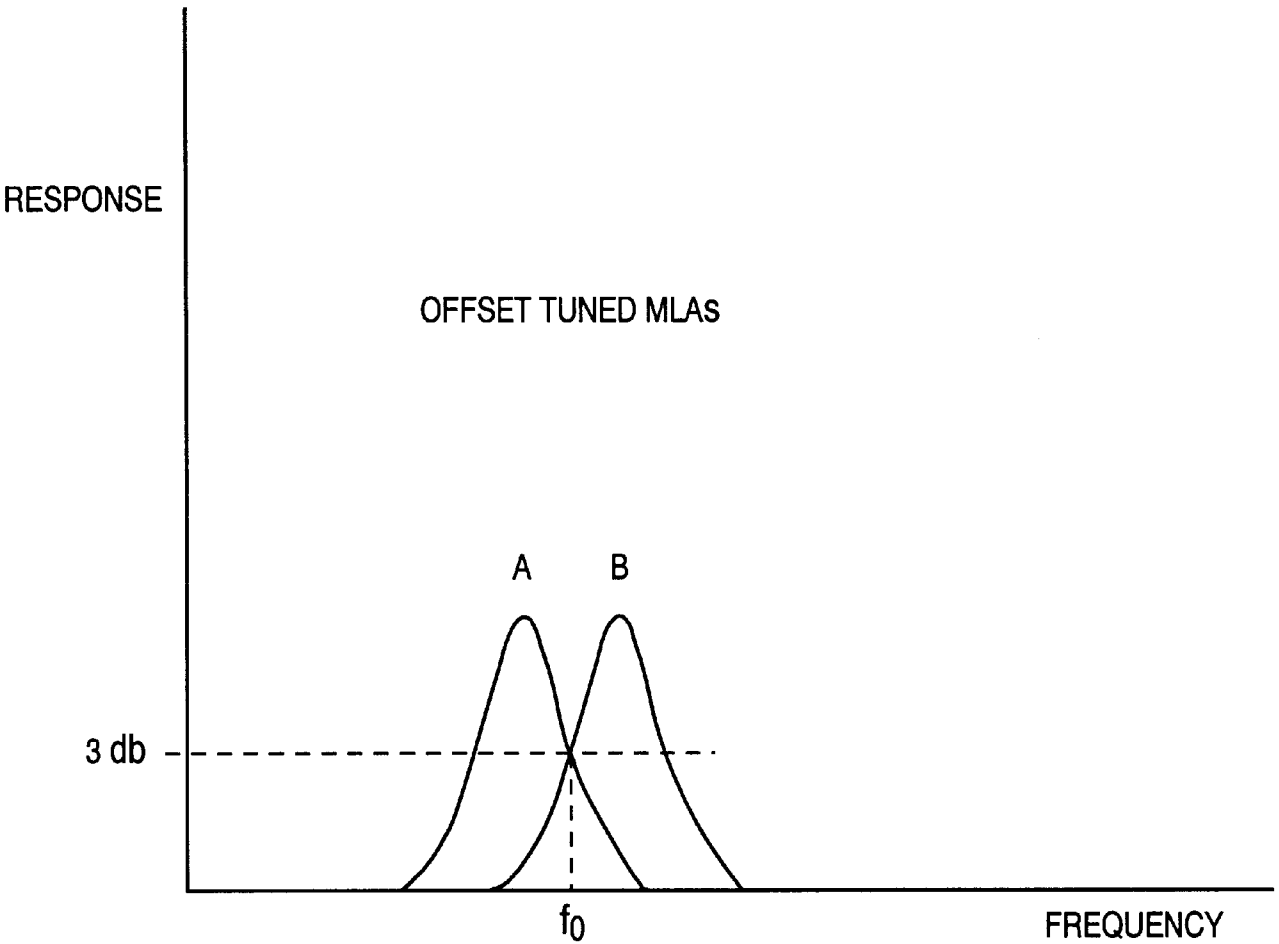
FIG. 6 is a graph of frequency response vs. frequency for the two elements of the dual-band antenna of FIG. 5.

As shown in FIG. 6, in order to achieve the required frequency and polarization for other applications such as the cellular phone mode of operation, MLA elements 130, 140 are offset-tuned and the crossed MLA frequency responses overlap at the 3 dB point in the frequency domain. The first MLA element 130 may be represented as curve A, while the orthogonal MLA element 140 may be shown as curve B. The center frequency, $F_O$, is the average of the two tuned antennas 130, 140 and is the 3 dB point. The offset tuning offsets the quadrature feed relationship and puts the monopole mode resonant frequency in phase with each other. While the slight asymmetry introduced by this offset tuning has no practical effect on the GPS operating mode of the antenna, it provides the proper voltage/current phase relationship and the required vertical polarization when the antenna is operated in the cellular phone mode.

In one embodiment the capacitive flaps are metal and coated with a dielectric. They are fastened to either the top or side surfaces of the conductors. The flaps rely upon capacitive coupling with the elements to influence the performance. The spacing between the flap and the surfaces is one of the factors contributing to the capacitive value and the tuning process changes the spacing. In the preferred embodiment the flaps are bendable and allow movement while also being rigid enough to maintain the moved position.

The flaps can be attached to either the horizontal or vertical surfaces. And, there can also be multiple flaps on a single surface. The flaps can be secured in a number of ways, including soldering, welding, or adhered with electrically or insulating conducting adhesives. One end of the flaps can be grounded, either on the vertical or horizontal surface and bent over the gap. Or, the flaps can be isolated on both surfaces and merely capacitively couple at the gap. In one embodiment there are shims of differing thickness placed between the flap and the surface and used to accurately space the flaps from the respective surface. In addition, the flaps can be mounted on the interior and function as disclosed herein, especially for production models that require minimal tuning.

In the disclosed embodiment the flaps 122 are bent over the gaps 106 and positioned in close proximity to, but not to be in direct contact with the side panels 132, 142. The tuning process can be done in either order, but essentially involves lowering the resonant frequency by adjusting the spacing between the flaps and the side pieces 132, 142, thereby changing the capacitance. Then, once the desired frequency is obtained for both structures, the structure is offset tuned by manipulating the flaps 136, 146 of one of the elements 130, 140.

For example, once the frequency band of the structures 130, 140 are lowered to the proper frequency band of interest, the lower element 130 is further tuned to a lower frequency, for example 820 MHz. This additional tuning is performed to place the lower element 90 degrees out of phase in the opposite direction than the upper element 140, thereby canceling the phase difference and resulting in a zero degree phase difference with a center frequency that is the average of the upper and lower elements 130, 140.

The two step tuning process is merely one embodiment and performed in order to alter both the frequency and phase. Other applications may only require altering a single factor such as only changing the frequency or only altering the phase. In those situations, only a single set of flaps would be required.

It will be clear to those skilled in the art that there are obvious variations to the structure chosen for purposes of disclosure. Different operating frequency bands or polarization combinations could be required to meet other operating environments or requirements. Capacitive flaps, for example, could be applied to one or both MLA elements.

Figure 7:
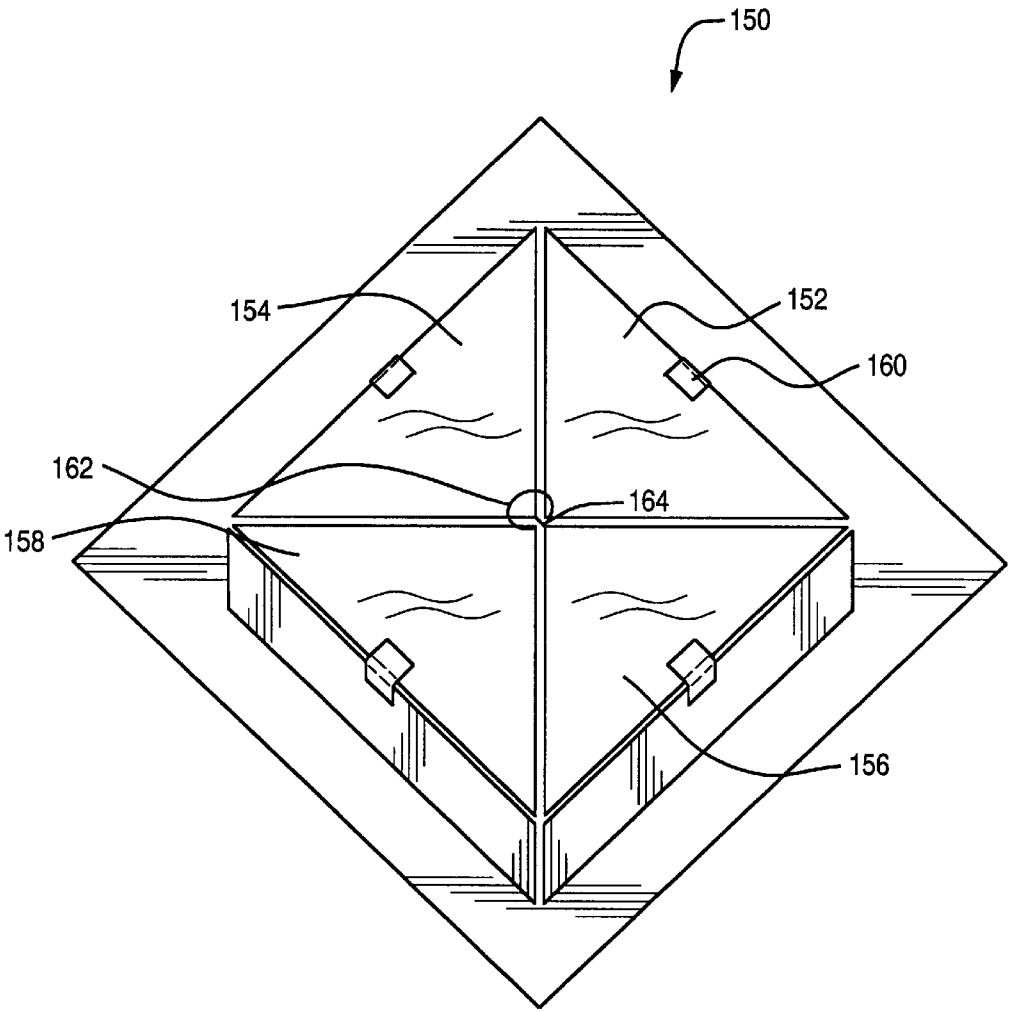
FIG. 7 is a schematic, cross-sectional view of a bow-tie MLA loop element with capacitive flaps added to lower the monopole resonant frequency.

An example of another structure is shown in FIG. 7, wherein a 'bow-tie' arrangement is illustrated. In this embodiment the structure is symmetrical and without crossed elements. This tuning process is less complex and requires fewer iterations than that of the crossed orthogonal elements as the shadowing and cross-coupling are reduced. The capacitive flaps may be mounted upon all four sections 152, 154, 156, 158 or upon at least two sides to allow for adequate tuning. A further description of the bow-tie antenna is described in U.S. Pat. No. 6,373,446 entitled NARROW BAND, SYMMETRIC, CROSSED, CIRCULARLY POLARIZED MEANDER LINE LOADED ANTENNA filed May 31, 2001 by the same inventor.

Since other modifications and changes varied to fit particular operating conditions and environments or designs will be apparent to those skilled in the art, the invention is not considered limited to the examples chosen for purposes of disclosure, and covers changes and modifications which do not constitute departures from the true scope of this invention.

Having thus described the invention, what is desired to be protected by letters patents is presented in the subsequently appended claims.

What is claimed is:

1. A dual-band antenna for simultaneous operation in a first frequency band and a second frequency band, comprising:

a) a ground plane;

b) a first meander line loaded antenna element tuned to a first loop mode frequency and having a first monopole resonant frequency, said first antenna element being disposed upon said ground plane, wherein said first meander line loaded element comprises a first pair of vertical sides extending approximately perpendicularly from said ground plane and a first horizontal section juxtaposed between said vertical sides, wherein there are gaps between said first horizontal section and said vertical sides with a first meander line mounted at said gaps;

c) a second meander line loaded antenna element tuned to a second loop mode frequency, said second antenna element having a second monopole resonant frequency, said second antenna element being disposed upon said ground plane, wherein said second meander line loaded element comprises a second pair of vertical sides extending approximately perpendicularly from said ground plane and a second horizontal section juxtaposed between said vertical sides, wherein there are gaps between said second horizontal section and said vertical sides with a second meander line mounted at said gaps;

d) a means for capacitive tuning said first monopole resonant frequency of said first antenna element to a first monopole frequency; and e) a means for capacitive tuning said second monopole resonant frequency of said second antenna element to a second monopole frequency.

2. The dual-band antenna according to claim 1, wherein said first frequency band is centered at approximately 850 MHz and said second frequency band is centered at approximately 1.5 GHz.

3. The dual-band antenna according to claim 1, wherein said means for capacitive tuning comprises one or more flaps affixed to said first and second antenna elements.

4. The dual-band antenna according to claim 1, exhibiting vertical polarization in said first frequency band and circular polarization in said second frequency band.

5. The dual-band antenna according to claim 1, wherein said first and said second monopole frequency are tuned to different values such that a center frequency is approximately 3 dB in the frequency domain.

6. A dual-band antenna for simultaneous operation in two frequency bands, comprising:

a) a ground plane;

b) a first meander line loaded antenna element tuned to a first loop mode frequency and having a first monopole resonant frequency, said first antenna element being disposed upon said ground plane, wherein said first meander line loaded element comprises a first pair of vertical sides extending approximately perpendicularly from said ground plane and a first horizontal section juxtaposed between said vertical sides, wherein there are gaps between said first horizontal section and said vertical sides with a first meander line mounted at said gaps;

c) a second meander line loaded antenna element tuned to a second loop mode frequency and disposed substantially orthogonal and crossing said first antenna element and disposed upon said ground plane, said second antenna element having a second monopole resonant frequency, wherein said second meander line loaded element comprises a second pair of vertical sides extending approximately perpendicularly from said ground plane and a second horizontal section juxtaposed between said vertical sides, wherein there are gaps between said second horizontal section and said vertical sides with a second meander line mounted at said gaps;

d) one or more capacitive flaps mounted to said first antenna element for tuning said first monopole resonant frequency; and e) one or more capacitive flaps mounted to said second antenna element for tuning said second monopole resonant frequency.

7. The dual-band antenna according to claim 6, wherein said flaps are metal with insulating dielectric surrounding said metal.

8. The dual-band antenna according to claim 6, wherein said one or more capacitive flaps are exteriorly disposed upon said antenna elements.

9. The dual-band antenna according to claim 6, wherein said one or more capacitive flaps are interiorly disposed upon said antenna elements.

10. The dual-band antenna according to claim 6, wherein said one or more capacitive flaps are electrically connected to said horizontal section and isolated from said vertical sides.

11. The dual-band antenna according to claim 6, wherein said one or more capacitive flaps are electrically connected to said vertical sides and isolated from said horizontal section.

12. The dual-band antenna according to claim 6, wherein said one or more capacitive flaps are electrically isolated from said vertical sides and said horizontal section.

13. The dual-band antenna according to claim 6, wherein said tuning is performed by adjusting a spacing between said vertical sides and said flaps.

14. The dual-band antenna according to claim 6, produced by the process of:

a) tuning said first monopole resonant frequency to a desired monopole frequency band;

b) tuning said second monopole resonant frequency to said desired monopole frequency band;

c) offset tuning either said first or second antenna element to produce a zero degree monopole phase difference between said first and second antenna element.

15. A dual-band antenna comprising:

a) a ground plane;

b) a first bow-tie meander line loaded antenna element tuned to a first loop mode frequency and having a first monopole resonant frequency, said first antenna element being disposed upon said ground plane, wherein said first bow-tie meander line loaded element comprises a first pair of opposing vertical sides extending approximately perpendicularly from said ground plane and a first pair of triangle-shaped horizontal sections extending from said vertical sides, wherein there are side gaps between said horizontal sections and said vertical sides with a first pair of meander lines mounted at said side gaps;

c) a second bow-tie meander line loaded antenna element tuned to a second loop mode frequency and disposed substantially orthogonal to said first antenna element and upon said ground plane, said second antenna element having a second monopole resonant frequency, wherein said second bow-tie meander line loaded element comprises a second pair of opposing vertical sides extending approximately perpendicularly from said ground plane and a second pair of triangle-shaped horizontal sections extending from said vertical sides, wherein there are side gaps between said horizontal sections and said vertical sides with a second pair of meander lines mounted at said side gaps;

d) one or more capacitive flaps mounted to said first antenna element for tuning said first monopole resonant frequency; and e) one or more capacitive flaps mounted to said second antenna element for tuning said second monopole resonant frequency.

16. The dual-band antenna according to claim 15, wherein said one or more capacitive flaps are exteriorly disposed upon said antenna elements.

17. The dual-band antenna according to claim 15, wherein said one or more capacitive flaps are interiorly disposed upon said antenna elements.

* * * * *